US005726377A

United States Patent [19]

Harris et al.

[11] Patent Number: 5,726,377

[45] Date of Patent: Mar. 10, 1998

[54] GAS OPERATED FIREARM

[75] Inventors: Michael R. Harris, Dover, Fla.; James F. Taylor, Wethersfield, Conn.

[73] Assignee: Colt's Manufacturing Company, Inc., West Hartford, Conn.

[21] Appl. No.: 670,661

[22] Filed: Jun. 19, 1996

[51] Int. Cl.[6] ..... F41A 5/10; F41A 3/00

[52] U.S. Cl. ..... 89/191.01; 89/190; 42/65; 42/69.03

[58] Field of Search ..... 89/177, 179, 190, 89/191.01, 191.02, 192, 193, 198; 42/65, 69.01, 69.03, 97

[56] References Cited

U.S. PATENT DOCUMENTS

| | | | |
|---|---|---|---|
| 3,236,155 | 2/1966 | Sturtevant | 89/199 |
| 3,292,492 | 12/1966 | Sturtevant | 89/128 |
| 3,348,328 | 10/1967 | Roy | 42/73 |
| 3,366,011 | 1/1968 | Sturtevant | 89/198 |
| 3,618,248 | 11/1971 | Into et al. | 42/71.01 |
| 3,670,442 | 6/1972 | Kennedy et al. | 42/70.08 |
| 3,776,096 | 12/1973 | Donovan | 89/192 X |
| 4,015,512 | 4/1977 | Feerick | 89/190 |
| 4,123,963 | 11/1978 | Junker | 89/179 X |
| 4,174,654 | 11/1979 | Liedke | 89/191.02 |
| 4,270,437 | 6/1981 | Donovan | 89/192 |
| 4,383,383 | 5/1983 | Landry | 42/65 X |
| 4,475,438 | 10/1984 | Sullivan | 89/191.01 |
| 4,505,183 | 3/1985 | Grehl | 89/191.01 |
| 4,536,982 | 8/1985 | Bredbury et al. | 42/71.01 |
| 4,553,469 | 11/1985 | Atchisson | 89/191.02 |
| 4,658,702 | 4/1987 | Tatro | 89/139 |
| 4,663,875 | 5/1987 | Tatro | 42/71.01 |

*Primary Examiner*—Michael J. Carone
*Assistant Examiner*—Matthew J. Lattig
*Attorney, Agent, or Firm*—Perman & Green, LLP

[57] ABSTRACT

A known gas operated firearm has been modified to be of more compact size and reduced weight while retaining the firepower, the features, and most of the components of its predecessor. A bolt assembly reciprocably mounted in a longitudinal cavity of a receiver assembly for movement between recoil and battery positions has a forwardly facing pressure surface and first and second longitudinally extending coaxial bores. The annular flange of a firing pin is slidable in the second bore and the bolt assembly includes a transversely extending retaining pin engageable by the annular flange to define an aftward terminal position of the firing pin. A recoil assembly includes a pair of tungsten weights mounted in the longitudinal cavity for rectilinear movement with the bolt assembly between the recoil and battery positions and includes means to bias the bolt assembly toward the battery position. A trigger mechanism includes a hammer biased for movement toward the firing position from a cocked position whose recessed face squarely impacts the firing pin. A second transversely extending recess in the hammer face provides clearance for the transversely extended retaining pin. Expanding gases from a cartridge whose bullet has passed a gas port proceeds past the gas port, then through a gas passage tube and against the pressure surface of the bolt assembly for driving the bolt assembly toward the recoil position. The tungsten weights are of a magnitude coordinated with the velocity of the recoil assembly so as to reduce rebound in the battery position of assembly during automatic fire.

12 Claims, 5 Drawing Sheets

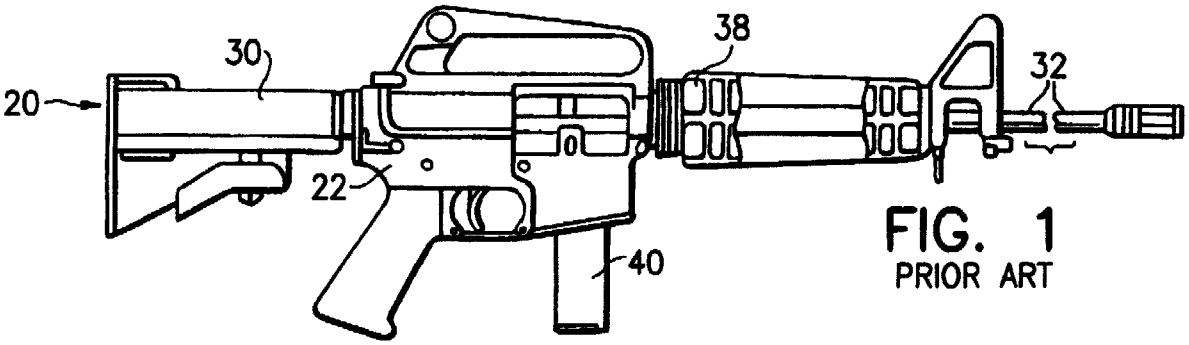
FIG. 1
PRIOR ART
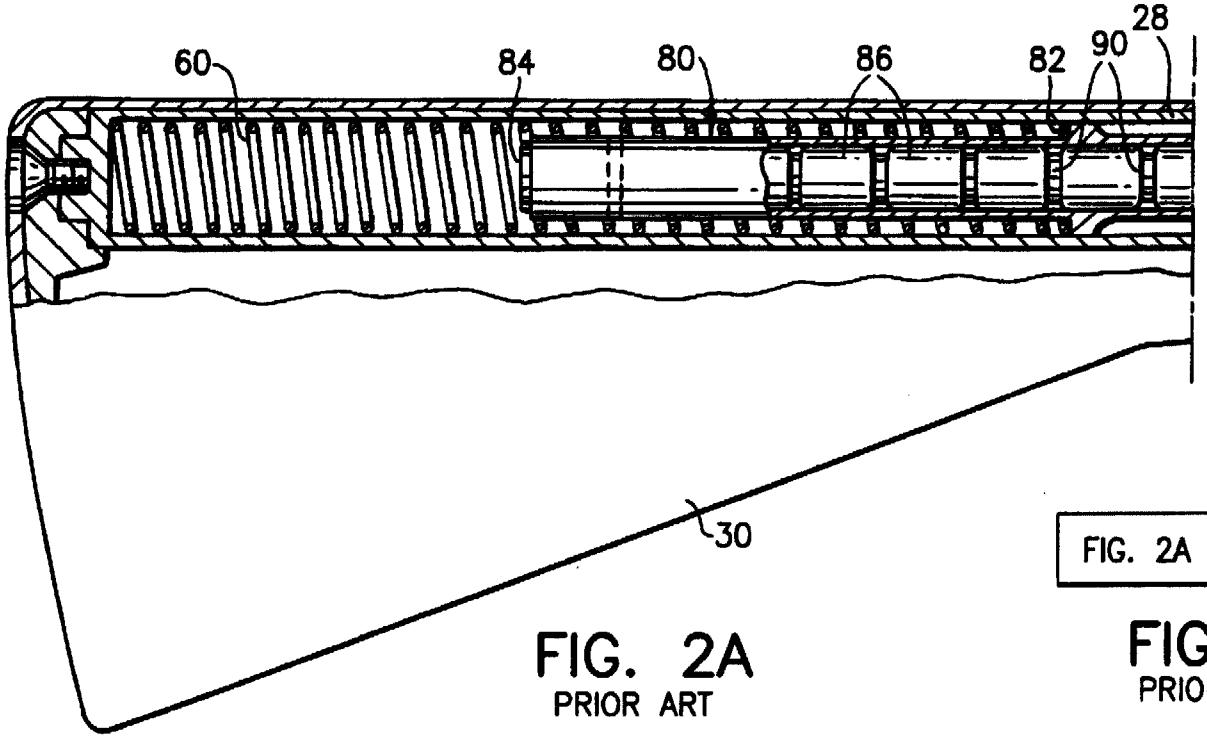
FIG. 2A
PRIOR ART
| FIG. 2A | FIG. 2B |
|---|---|
FIG. 2
PRIOR ART

GAS OPERATED FIREARM

BACKGROUND OF THE INVENTION

1. Field of the Invention

The present invention relates generally to gas operated firearms and, more particularly, to a new and improved gas operated firearm of more compact size and reduced weight while retaining the firepower of its predecessor and most of the components and other desirable features of its predecessor. The modifications described herein result in a firearm with unique characteristics, combining the compactness, light weight, and low recoil of a sub machine gun with the ballistic effectiveness of an assault rifle. These unique and highly significant improved characteristics are achieved with minimal changes to the components of the existing M16type design.

2. Description of the Prior Art

The mini assault rifle system (MARS) of the present invention introduces a revolutionary new class of weapon unique to military small arms. Military individual weapons generally consist of 9 mm pistols, 9 mm submachine guns and 5.56 mm or 5.56 mm rifles. Pistols are for individual protection and do not have range (25–50 m), probability of hit, or probability of kill to contribute to the mission in a fire fight. They are light and the holster allows hands free carry. However, the proliferation of assault rifles and submachine guns has made the pistol obsolete as a military weapon offering little protection from the overwhelming firepower of submachine guns and assault rifles. A down sized military, modern fluid battlefields and constant rear area threat from conventional and unconventional threats calls to question the practice of equipping troops with an inadequate personal defense weapon and giving them no ability to contribute to force protection or a close quarters battle.

Submachine guns, while lightweight and compact, suffer from the inadequacies of the 9 mm pistol cartridges they fire. Their effective range is limited to about 100–150 m with limited penetration and lethality. Recent combat operations in Grenada, Panama, Kuwait, and Somalia have painfully demonstrated the ineffectiveness of the 9 mm weapons in battle against weapons such as the 7.62×39 mm AK-47. On the other hand, the typical battle rifle in 7.62 mm or 5.56 mm/5.45 mm sizes is designed to fire 500–800 m. These weapons are designed to shoot much farther than the average soldier can locate, identify, or hit the enemy. The result is that the weapons are heavy, cumbersome, the ammunition is heavy, and the recoil, muzzle blast and flash are excessive. Studies have shown that 85% of the target engagements are at distances of 300 m or less and 25% are with full-automatic fire while these weapons are difficult to control and impossible to aim during automatic firing.

There is a noteworthy listing of patents relating to gas operated firearms in general and particularly directed to the type of firearm used by the U.S. military services known as the M16 rifle and civilian variants of the M16 rifle.

Without intending to be exhaustive of the commonly assigned patents relating to the M16 rifle and its genre, the following U.S. patents disclose various features which are of importance for understanding the improvements provided by the present invention.

U.S. Pat. No. 3,348,328 to Roy discloses a size adjustable buttstock assembly which is adjustable in length for comfortable use by individuals of a variety of sizes and which is particularly suited to be completely field stripped in a matter of seconds. In this same context, U.S. Pat. No. 3,618,248 to Into et al. discloses a modified buttstock assembly which is provided with a storage compartment in the buttstock capable of carrying all the cleaning and servicing equipment necessary to maintain the firearm and a removable butt plate having a latchable door providing access to the compartment.

U.S. Pat. No. 3,236,155 to Sturtevant discloses an improved mechanism to insure the full and positive closure of the bolt assembly of an automatic firearm despite the failure of such assembly to automatically close in the normal fashion. This mechanism is intended for use in automatic firearms of the type having an enclosed reciprocating bolt assembly which must be fully closed in order for the firearm to fire.

U.S. Pat. No. 3,366,011 to Sturtevant discloses an automatic firearm having a bolt assembly and a coaxial recoil assembly mounted for rectilinear movement between battery and recoil positions at a high rate of reciprocation. In this instance, the recoil assembly is provided a longitudinal cavity housing an elongated mass segmented into a plurality of coaxial weights spaced apart by washers having a low coefficient of restitution, the weights having a lost motion connection with each other and with the recoil assembly to apply their respective inertias in a delayed sequence to oppose rebound of a bolt assembly from the battery position.

U.S. Pat. No. 4,536,982 to Bredbury et al. discloses a rifle which comprises identical top and bottom mating sections thereby eliminating the need for two sections of differing construction. The sections are of a ribbed configuration to assure the ability of a user in securing a firm grip and vent holes are provided in appropriate locations for maximum cooling of the exterior surface of the handguard.

U.S. Pat. No. 4,663,875 to Tatro discloses a hand guard assembly with an improved configuration and venting to assure maximum circulation of cooling air.

U.S. Pat. No. 3,292,492 to Sturtevant discloses a trigger mechanism which is capable of providing automatic, semiautomatic and burst firing of a firearm by the selective control of the operation of the hammer.

U.S. Pat. No. 3,670,442 to Kennedy et al. discloses a mechanism for insuring that a semiautomatic firearm cannot be readily converted into an automatic firearm. Using the techniques of this particular invention, an automatic firearm may be converted into a semiautomatic firearm, but the conversion back to its original state cannot be achieved in a facile manner.

U.S. Pat. No. 4,658,702 to Tatro discloses another safety technique by reason of which a semiautomatic firearm cannot be readily converted into an automatic firearm.

It was in light of the foregoing state of the art that the present invention has been conceived and is now reduced to practice.

SUMMARY OF THE INVENTION

According to the invention, a successful gas operated firearm of known design has been modified resulting in one of more compact size and reduced weight while retaining the firepower of its predecessor and most of the components and other desirable features of its predecessor. A bolt assembly is reciprocably mounted in a longitudinal cavity of a receiver assembly for movement between recoil and battery positions and has a forwardly facing pressure surface and first and second longitudinally extending coaxial bores. The annular flange of a firing pin is slidable in the second bore and the bolt assembly includes a transversely extending retaining pin engageable by the annular flange to define an aftward terminal position of the firing pin. A recoil assembly includes a pair of tungsten weights mounted in the longitudinal cavity for rectilinear movement with the bolt assembly between the recoil and battery positions and includes means to bias the bolt assembly toward the battery position. A trigger mechanism includes a hammer biased for movement toward the firing position from a cocked position whose face has a first recess with a base surface for squarely impacting the firing base of the firing pin and a second transversely extending recess providing clearance for reception of the retaining pin thereby allowing unimpeded access of the hammer to the firing pin. Expanding gases from a cartridge whose bullet has passed a gas port proceeds past the gas port, then through a gas passage tube and against the pressure surface of the bolt assembly for driving the bolt assembly toward the recoil position. The tungsten weights are of a magnitude sufficient to limit rebound of the bolt carrier in the battery position and prevent misfires caused by an interference between the bolt carrier and the firing pin.

Indeed, the mini assault rifle system (MARS) of the invention is a new class of weapon that will provide a personal defense weapon system for self defense as well as for emergency force protection or close quarters combat. This weapon would obsolete 9 mm pistols and submachine guns among the military, special police, and security forces. It is envisioned to replace 80% of the pistols, all submachine guns, and 20% of the rifles and carbines in current inventories. The MARS weapon and ammunition is designed to overmatch threat weapons in speed and accuracy in the range of 0–300 meters, enhance lethality over the 9 mm and 5.7 mm weapons, have an increased capability for aimed automatic fire, and be lighter than current submachine guns. In consideration of current levels of defense spending, the MARS concept focused on keeping development, procurement, training, maintenance costs extraordinarily low for the introduction of such a quantum increase in battlefield capabilities.

The MARS program was designed to offer the maximum integrated value for the amount expended. The weapon and ammunition were designed to utilize current manufacturing facilities, materials, and practices so as to exploit unused capacity, reduce risk, cost, and schedule.

Critical interfaces are retained in the design to ensure interface with the accessories in the Modular Weapon Program, for example rail system, pistol grip, suppressor, visible/IR illuminators, visible/IR lasers, the Close Combat Optical Sight, Thermal Weapons Sight, controlled penetration projectiles, and the like.

The weapon system of the invention would provide superior fire power in a variety of applications. In a military application, effectiveness of a military weapon system must be assessed against the threat. Personnel defense and force protection for combat support/combat service support personnel and combat crewmen require a weapon with the range, accuracy, and lethality to overmatch the enemies' assault rifle capabilities. Terrorists attacks, raids, and ambushes by enemy commandoes, or penetrations will require rear area troops to defend themselves and their facilities. Effective fire is the key to disrupting the attack and over- taking the assailant. Combat support/combat service support and combat crewmen require a compact, lightweight weapon that allows a hands free carry. The ergonomics of the weapon and fire control must provide a high hit probability at short to medium ranges with an absolute minimum of training.

One typical specific use of the weapon system of the invention would be for the protection of downed helicopter crewmen. Recent conflicts have shown that if personnel engaged in evasion and recover can hold the enemy at bay for as little as 20 minutes, then airstrikes can be brought to bear and extraction by accompanying aircraft or a rescue mission mounted.

While 5.7 mm or 9 mm pistols and submachine-guns are compact and easy to carry, they lack sufficient range, power and accuracy to sustain an evader when outnumbered by even local militia armed with assault rifles such as the AK-47. The M16 and M4 type rifles are too cumbersome for the pilot and co-pilot in the cockpit. Anything not secured in close proximity to the cockpit crew is not likely to accompany them as they scramble out of a crashed aircraft. The amount of ammunition and level of marksmanship likely to be found among downed aircrews requires an enhanced fire control for a higher probability of hit. Reducing the firing signature to avoid detection and confuse pursuers is critical to the aircrews maintaining the tactical initiative.

Like aircrews, tankers (that is, crews in tanks and other armed vehicles) require a compact, light weapon that can be secured to him for hands free carry as he scrambles from a burning vehicle. The weapon must provide sufficient firepower to hold enemy infantry at bay until supporting armor or dismounted troops can assist.

MARS is also an ideal weapon for heavy weapons crews, snipers, special or urban reconnaissance teams.

In short, MARS provides the firepower required to survive the threats on the battlefield or behind the lines.

The weapon system of the invention would also be of considerable benefit in law enforcement. The police mini-carbine version of the MARS may be used in police scenarios facing rifles, shotguns, or terrorists, psychotic, or drug enhanced criminals. Police versions include a semiautomatic short barrel rifle for law enforcement sale only as a cruiser back up weapon for encounters with heavily armed criminals and SWAT teams. The MARS fires a 55 gr full metal jacket bullet at 2600 ft/sec, and with a variety of controlled penetration ammunition is both safer and more effective, reducing the risk to both law enforcement personnel and civilians.

Typical battlefield data shows the following types and frequencies of engagements that can be expected:

| RANGE (meters) | TARGET | TIME |
|---|---|---|
| 0–100 30–40% | Point 20–25% | •Day 50% |
| 0–200 65–75% | Group Source of fire or danger 55% | •Night 30% |
| 0–300 75–85% | Group Source of fire or danger 55% | •Mixed Dusk/Dawn 20% |
| 0–400 85–95% | Other buildings, vehicles, etc. 20% | |
| Firing Positions: | | •Firing Modes: |
| Prone w/wo cover or support | 25–30% | •Aimed semi-auto 15–20% |
| Standing or other stationary position | 30% | •Aimed full-auto 25% |
| Running, walking, moving vehicle | 40–45% | •Offhand/point 50% |

This data supports a light compact, quick handling, weapon whose ergonomics and sighting system supports point shooting at close range and the accuracy and lethality to reach 200–300 meters, day or night.

The MARS provides a weapons system that will meet all the requirements of a personal defense weapon system for self-defense and emergency force protection or even a close quarters combat capability. This weapon would obsolete the pistol and 9 mm submachine guns among the military, special police, and security forces. It is envisioned to replace 80% of the pistols, all submachine guns, and 20% of the rifles/carbines in current inventories. The M16 was designed using a light high velocity bullet to improve probability of hit and lethal capability while decreasing weight and increasing the soldier's ammunition load. The range requirement was 500 m and now with the M16 A2 has been increased to 800 m. The M16 rifle and its 5.56 mm cartridge were designed around bulky extruded Improved Military Rifle (IMR) powder. Later the Army changed to the denser ball powders causing major problems with reliability in combat. The rifle and ball powder had to be re-engineered in a compromise of the original design. The cartridge design and components are critical and drive the design of the gun. In contrast, the MARS weapon and ammunition were designed together.

The MARS cartridge is the center of the concept in developing the revolutionary weapon system of the invention. The MARS cartridge is designed as part of the weapon system and exploits the high energy densities of modern ball powders. It for the first time uses magnum pistol type powders burned at rifle pressures to achieve high rifle velocities in a short rifle barrel. It uses a fast ball powder to achieve 2600 ft/sec with a 55 gr full metal jacket projectile in only an 11 inch barrel. The high ballistic coefficient and high velocity result in a higher hit probability limiting the effects of range estimation, wind drift, and moving targets. When the MARS is battlesight zeroed at 200 m, the path of the bullet stays within 3 inches of the line of sight. At a range of 250 to 300 m, the operator only has to hold slightly higher on the target to achieve a hit. At 300 m, the bullet of the system of the invention is capable of penetrating the Army's personal armor system, specifically the KEVLAR® helmet and vest.

Accordingly, it is an object of the present invention to modify a successful known gas operated firearm of known design by reducing its size and weight while retaining its firepower and handling characteristics.

Another object of the invention is to provide such a modified firearm by revising a bare minimum number of components so as to assure maximum interchangeability in the field with the conventional firearm.

A further object of the invention is to provide such a firearm adapted to use an improved high performance cartridge but modified in its construction to accommodate the resulting characteristics of the improved cartridge and assure the continued timing of the operation of the trigger assembly and of the bolt assembly to assure proper feeding of a new cartridge into the firing chamber and ejection of a spent cartridge casing from the firing chamber.

Still a further object of the invention is to provide such a firearm according to which the receiver assembly is substantially shortened, the firing pin is shortened, and the hammer is recessed in order to assure that it squarely strikes the firing pin.

Yet a further object of the invention is to provide such a firearm in which a recoil assembly which serves to bias the bolt assembly toward the battery position includes a buffer mounting an elongated mass segmented into a plurality of coaxial weights having a lost motion connection with the buffer and with each other for transmitting to the bolt assembly the force resulting from their inertia in moving toward the battery position in a delayed sequence after the bolt assembly reaches the battery position.

Yet another object of the invention is to provide such a firearm utilizing only a pair of weights of tungsten or of other suitable dense, non-corrosive, material.

Still a further object of the invention is to provide such a firearm in which the weights are of a magnitude coordinated with the velocity of the recoiling assembly to maintain unimpeded access of the hammer to the firing pin in automatic fire while occupying a minimal volume.

Other and further features, advantages, and benefits of the invention will become apparent in the following description taken in conjunction with the following drawings. It is to be understood that the foregoing general description and the following detailed description are exemplary and explanatory but are not to be restrictive of the invention. The accompanying drawings which are incorporated in and constitute a part of this invention, illustrate one of the embodiments of the invention, and, together with the description, serve to explain the principles of the invention in general terms. Like numerals refer to like parts throughout the disclosure.

BRIEF DESCRIPTION OF THE DRAWINGS

In the drawings:

FIG. 1 is a side elevational view of a known firearm of the type which can be modified in accordance with the present invention;

FIG. 2 is a detail side elevational view of a portion of

FIG. 1 with certain parts being broken away and shown in section;

DETAILED DESCRIPTION OF THE PREFERRED EMBODIMENTS

Figure 2B:
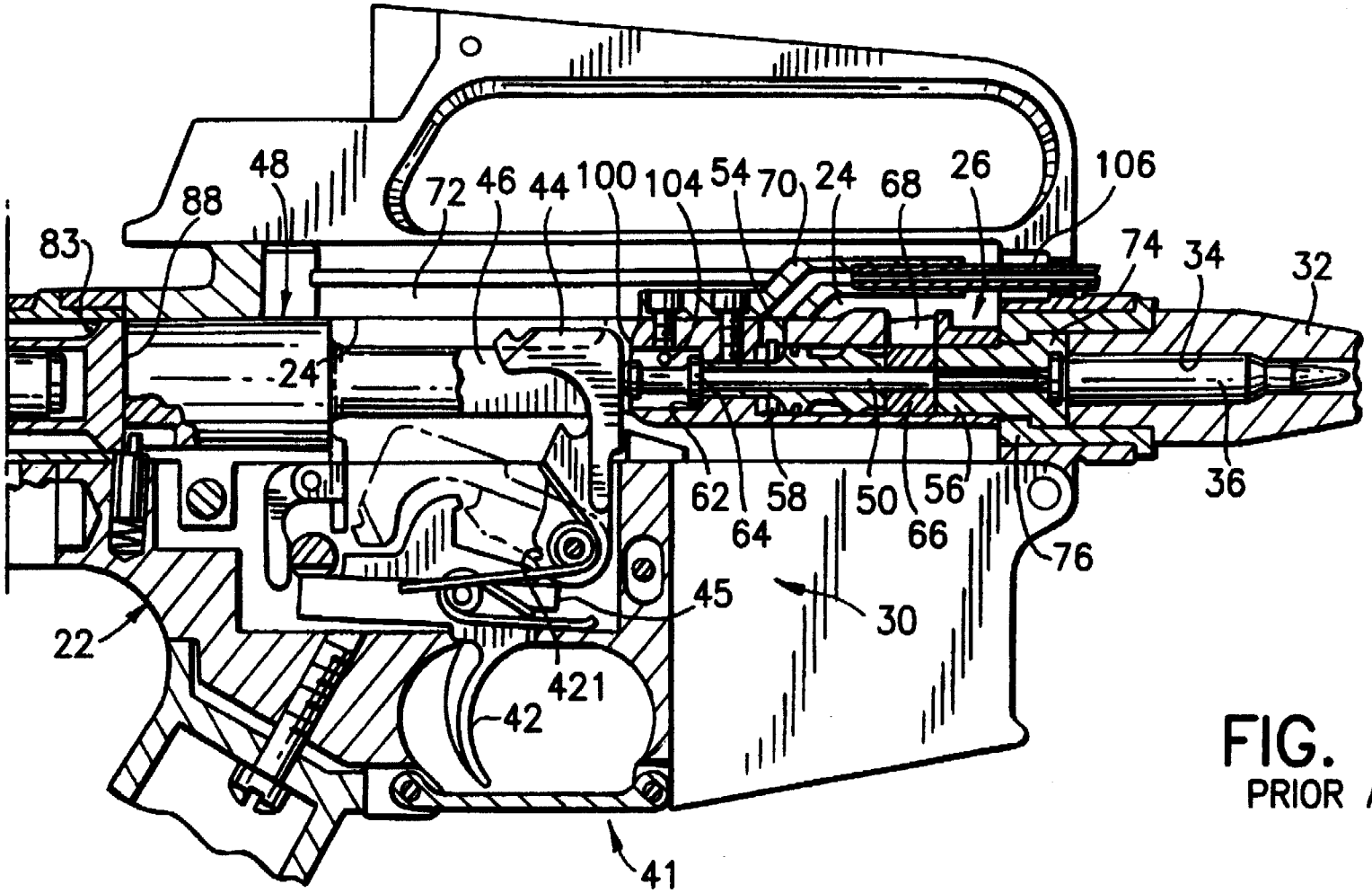
FIG. 2B PRIOR ART
Figure 3:
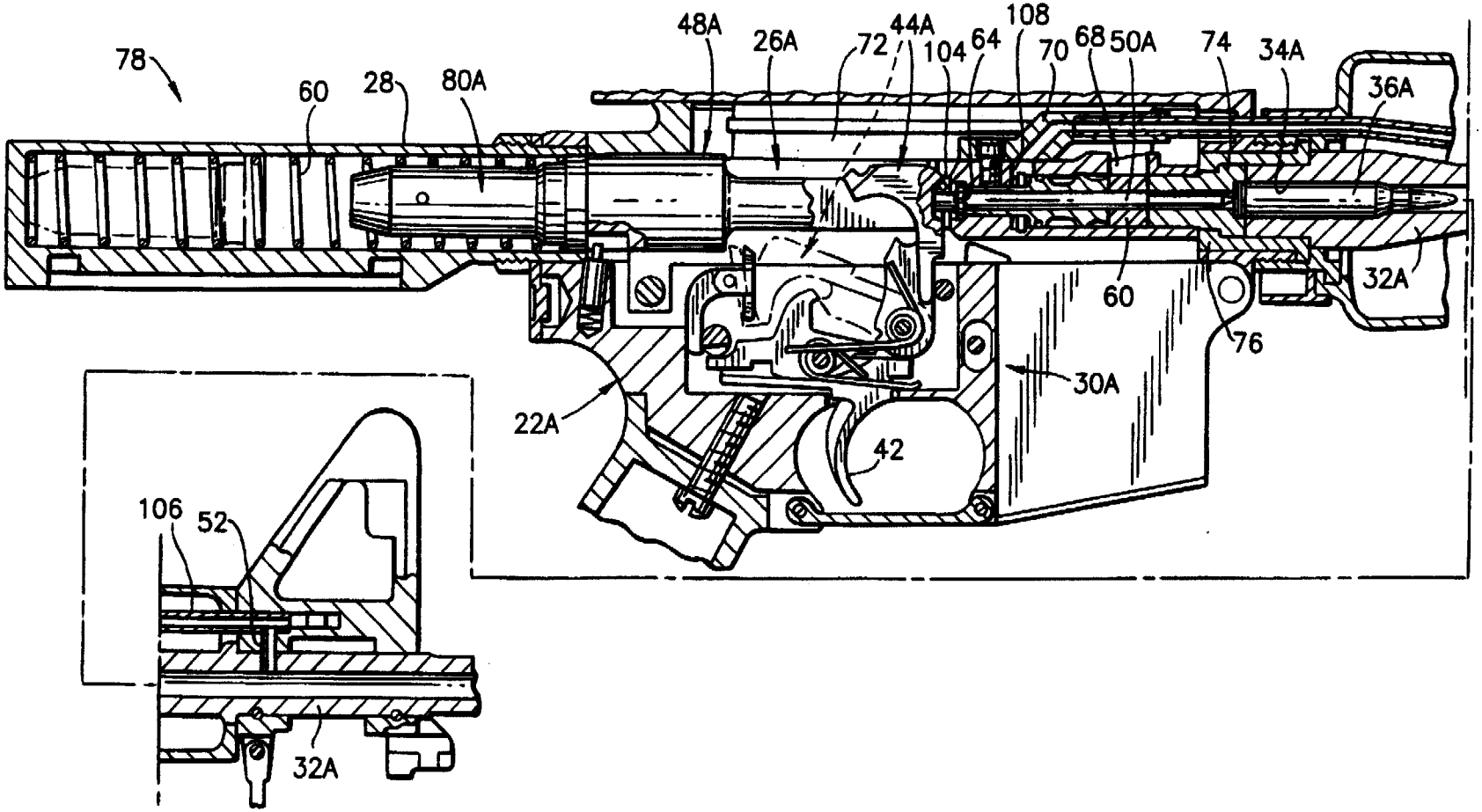
FIG. 3 is side elevational view, similar to FIG. 2, illustrating the changes which embody the present invention.
Figure 4:
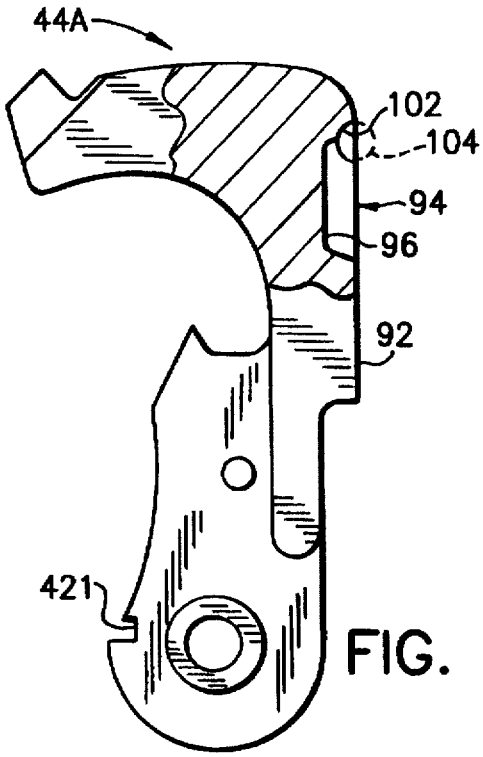
FIG. 4 is a detail side elevational view, partially cut away and shown in section, of a component illustrated in FIG. 3, namely, a hammer modified according to the invention.
Figure 5:
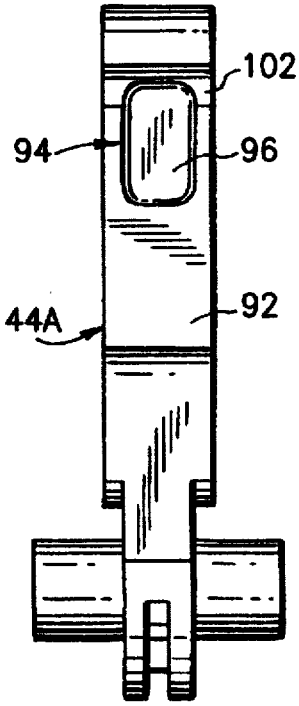
FIG. 5 is front elevational view of the component illustrated in FIG. 4.
Figure 7:
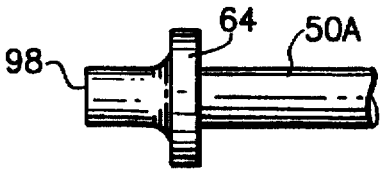
FIG. 7 is detail side elevation view illustrating one end of a firing pin modified according to the invention.
Figure 6:
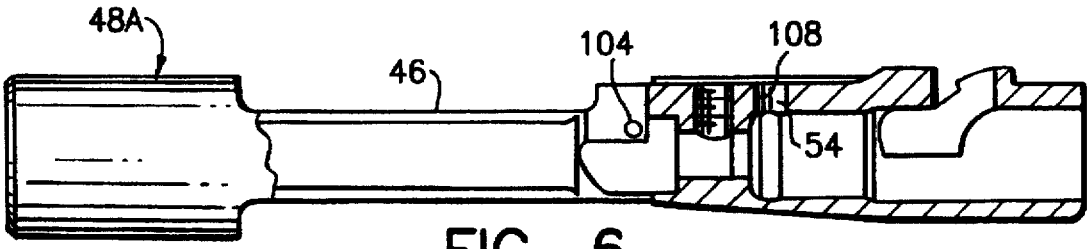
FIG. 6 is a detail side elevational view, partially cut away and shown in section, of another component illustrated in FIG. 3, namely, a bolt carrier modified according to the invention.

Turn now to the drawings and, initially, to FIG. 1 which illustrates an automatic firearm 20 of the gas operated type. The firearm 20 depicted is of a known design and may be, for example, an M16 rifle commonly used by United States military personnel. It comprises a receiver assembly 22, defining in the upper portion thereof, viewing FIG. 2, a chamber 24 for receiving a bolt assembly 26. The rear of the chamber 24 communicates with a receiver extension 28 located in stock 30. Operatively connected forwardly of the chamber 24 is a barrel 32 having a firing or cartridge chamber 34 in which may be positioned a cartridge 36. A handgrip 38 is mounted on the barrel 32 for isolating the hand of a shooter from direct contact with the barrel. A cartridge magazine 40 is attached to the underside of the receiver assembly 22 for delivery of cartridges 36 into the cartridge chamber 34.

A trigger mechanism 41 is generally similar in design and operation to the mechanism described in U.S. Pat. No. 3,236,155 and not described in detail herein. Suffice it to say, for the purposes of this invention, that upon pulling a trigger 42, a spring-biased hammer 44 is released after a trigger sear 45 is dislodged from a notch 421. This enables the hammer 44 to rotate clockwise through slot 43 of bolt carrier 48 to strike firing pin 50 to fire the cartridge 36. Thereupon, a portion of the expanding gases developed on firing the firearm passes through a gas port in the barrel 32 at the front sight, through the gas tube 106, and through a gas passage 54 on the bolt carrier 48 to actuate the automatic recoil of the bolt 56 and bolt carrier 48, causing ejection of the spent cartridge shell and subsequent successive chambering of the cartridges 36 located in the cartridge magazine 40 as the bolt carrier returns to battery position after recoil.

The details of the mechanism for providing the gas operated automatic recoil are more fully set forth in U.S. Pat. No. 2,951,424. As more fully set forth in that patent, a chamber 58 defined by a bolt 56 and the bolt carrier 48 fills with high pressure exhaust gas on the firing of a cartridge 36 driving the bolt carrier 48 rearwardly within the chamber 24 against the bias of recoil spring 60 and initially causing an annular shoulder 62 of the carrier 48 to contact an annular flange 64 of firing pin 50 while at the same time, by virtue of the lost motion connection between the carrier 48 and the bolt 56, causing a bolt cam pin 66 to travel in a helical slot 68 cut in the bolt carrier 48. The movement of the cam pin 66 within the helical slot 68 causes relative rotation of the bolt and the bolt carrier 48, the latter being held against rotation by the cooperation of carrier key 70 with the longitudinal groove 72 of the receiver assembly 22.

Rotation of the bolt 56 results in the registry of bolt lugs 74 and the slots between the inwardly protruding lugs 76 on the breech end of the barrel thereby permitting rearward movement of the bolt and bolt carrier upon continuing recoil of the carrier. The rearward momentum of the recoiling bolt assembly is absorbed by the compression of recoil spring 60 which, upon dissipation of the rearward momentum of the carrier, acts upon the bolt assembly to return it to the locked battery position. During the recoiling operation, the expended cartridge 36 is, of course, ejected and a new cartridge fed from the magazine 40 into the firing chamber 34. As will be appreciated, it is essential that the bolt 56 be fully closed and locked and that the bolt carrier 48 be in its full forward position in order to fire the gun.

A recoil assembly 78 of conventional design such as disclosed in U.S. Pat. No. 3,366,011 includes a generally tubular buffer body 80 having a closed forward end engaging the rearward end of bolt carrier 48 and mounted for reciprocation in receiver extension 28. The buffer body was formed of a lightweight aluminum alloy to provide a low coefficient of restitution to minimize buffer rebound from or separation of the buffer from the carrier at battery impact and was provided with generally annular guide flanges 82, 83 to mount the same in the tube extension 28 with the flange 82 further providing a seat for the end of recoil spring 60 which concentrically surrounds the rearward end of the buffer body. A bumper 84 preferably formed of polyurethane of high durometer hardness is preferably formed on the aft end of the buffer body 80 to minimize the shock waves and vibrations otherwise imposed by a sharp blow as the buffer body bottoms in receiver extension 28 at recoil position.

Disposed within the buffer body 80 is a plurality of weights 86 (shown as being five in number). Interposed between each adjacent pair of weights 86 and between the forward weight and a buffer end 88 is a washer 90 formed of a material having a very low coefficient of restitution, or resiliency, such as buna N rubber or polyurethane. The combined length of the weights 86 and the washers 90 within the buffer body 80 is less than the length of the bore within the receiver extension 28. It is desirable that the weights 86 be heavy enough to provide a sufficient amount of effective force resisting carrier bounce at the battery position as hereinafter more fully described.

The operation of the firearm 20 is generally as follows. The trigger 42 is pulled to release the hammer 44 which moves upwardly through the vertical slot 46 in the bolt carrier 48 to strike the firing pin 50 to fire the cartridge 36 chambered in the gun barrel. The expanding gas, due to the discharge of the cartridge, forces the bolt carrier 48, and then bolt 56, rearwardly against the bias of spring 68 which absorbs the recoil. As the bolt carrier 48 reaches the end of the recoil stroke, the bumper 84, which is formed of a material having a low coefficient of restitution, bottoms against the end wall of the receiver extension 28 with the bumper reducing the sharpness of the shock waves which the buffer might otherwise transmit through the recoil mechanism and the bolt carrier mechanism. The weights 86, being loosely disposed in the buffer body 80, move to the rear of the buffer body and are bottomed in its rearward position at the moment of impact due to the reducing velocity of the buffer as it moves toward recoil position against the bias of spring 60.

As the recoil spring 60 moves the buffer body 80 and the bolt carrier 48 forwardly toward battery position, the bolt 56 engages another cartridge 36 and chambers it.

It was earlier explained that the invention relates to a new and improved gas operated firearm which is of more compact size and reduced weight while retaining the fire power of its predecessor and most of the components and other desirable features of its predecessor. Typical of the changes wrought and embodied by the invention are a firearm having an overall length reduced to 24.3 inches from 29.8 inches and a weight of 4.75 lbs. reduced from 5.65 lbs. when compared to the shortest variant of the M16 in official service, namely, an M4-type carbine. In similar fashion, the length of the barrel has been reduced by 3.5 inches to 11.0 inches for the new barrel, the receiver assembly has been shortened by 0.550 inches to a new length of 7.25 inches and the receiver extension has been shortened by 1.3 inches to 5.9 inches. At the same time, it is desired to retain, to the maximum extent possible, the components of the earlier version of the firearm and their relative placement in order to assure interchangeability not only in product but also on the battlefield.

For a description of this modified firearm, turn now to FIGS. 3–8. Where components have been substantially unaltered, the reference numerals remain unchanged; where they have been substantially modified, the same number is used with a letter suffix "A". Thus, in FIG. 3, the modified receiver assembly 22A, as noted above, has been shortened but without drastically altering the relative relationship of the components in the trigger mechanism 41 and in the bolt assembly 26. The modified firearm of the invention utilizes a novel cartridge which has been developed to provide a more compact weapon, while maintaining its lethality and increasing the number of rounds that can be carried on a mission without any increase in overall weight to the soldier. This novel cartridge also takes up less volume per round.

In the course of development of the new system, the inventors were required to address several problems which arose related to the short 11" barrel used by the improved version of the firearm of the invention. The following were typical of the problems faced by the inventors:

The novel cartridge required a faster burning propellant to insure complete combustion prior to projectile exit, thereby achieving maximum efficiency.

The novel cartridge required "tuning" the gas system to insure proper function, that is, ejection and feeding at the lowest possible cyclic rate, as the gas port is much closer to the chamber.

Muzzle blast and muzzle flash needed to be minimized as much as possible by selecting the most favorable propellant.

It is expected that the barrel of the firearm will incorporate a 1 in 9" (1/9") twist, but a 1 in 7" (1/7") may be usable.

The use of a shorter cartridge case necessitated using a more powerful, less bulky propellant.

Figure 9:
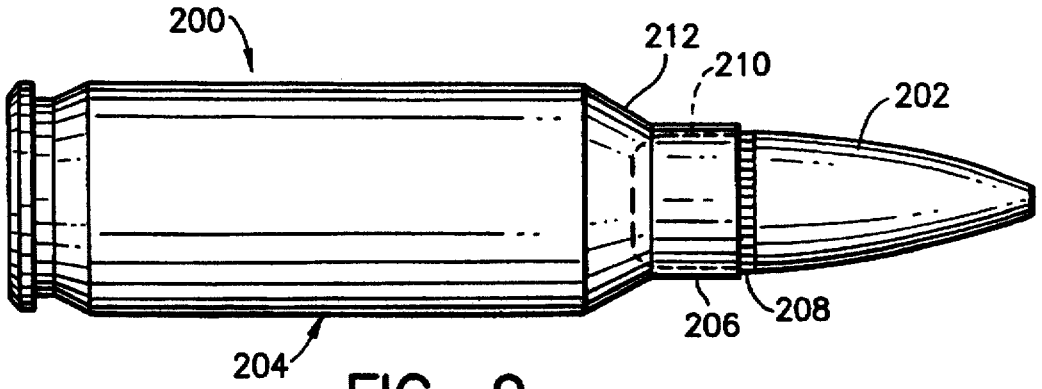
FIG. 9 is a detail elevation view of a cartridge for the mini assault rifle system (MARS) of the invention.

It was earlier explained that the MARS cartridge is the center of the concept in developing the revolutionary system of the invention. Viewing FIG. 9, the MARS cartridge is illustrated at 200. Rather than the 55 gr M193 bullet with a Ballistic Coefficient (BC) of only 0.243, the 5.56×30 mm MARS uses a commercially available 55 grain full metal jacket bullet 202 with a BC of 0.272. This produces a flatter trajectory and retains more energy to deliver to the target than an M193 bullet launched at the same velocity. The cartridge is loaded with 16.8 gr of a commercially available ball powder to provide a 2600 ft/sec velocity with complete burning resulting in a low muzzle flash and blast when compared to an M193 or M855 bullet fired in an 11 inch barrel.

The MARS cartridge case 204 is unique in the efficiency of the design. The 300 m range, penetration, and lethality are based on launching the 55 gr projectile at 2600+ft/sec. The cartridge neck 206 is only long enough to support the bearing surface of the 55 gr full metal jacket bullet which runs from the cannelure groove 208 to the slope of the boat tail 210. This is the shortest neck of any military cartridge.

The angle of the shoulder 212 of the cartridge, taken from a longitudinal axis thereof, is 30 degrees. This is the steepest shoulder that can be mass produced and allows for maximum powder capacity. The body has less taper than the M193 or M855 bullet since the short case has less surface area friction to overcome during extraction. The case head and wall thickness retain military and SAMMI (Small Arms and Ammunition Manufacturers Institute) specifications to ensure a safe operating pressure of 55,000 psi. The cartridge is loaded to an overall length of 1.7 inches. The size and shape enhance the feeding over the M193 and M855 type cartridges. Military and SAMMI specifications are used on 5.56×30 mm MARS cartridge wall thickness to include side walls, shoulder and case mouth.

Description of 5.56×30 mm MARS Cartridge

Caliber: 0.224 inches (5.56 mm)
Bullet: 55 gr Full Metal Jacket Boat Tail
Bullet length: 0.752 inches
Load: 16.8 gr of a commercially available ball propellant
Primer: commercially available 71/2
Muzzle Velocity (11 inch barrel) 2600+fps
Muzzle Energy (11 inch barrel) 825+ftlb
Cartridge dimensions (inches):

Outside diameter of neck 0.253
Outside diameter of case below shoulder 0.369
Outside diameter of case near base 0.376
Overall case length 1.2
Length to top of shoulder 1.05
Length to base of shoulder 0.95
Loaded cartridge overall length 1.7

The MARS cartridge exploits currently with ammunition packing and weather proofing and current military logistics capabilities. It significantly reduces the cost of developing and certify packing normally associated with the development of a new round. MARS ammunition is packed in standard 5.56×45 mm 10 round stripper clips, bandoleers and ammunition cans. The 5.56×30 mm MARS is short enough that the cartridge shoulders do not overlap in the bandoleer pouches. Four 10 rounds strips are packed in each pouch on the bandoleer and seven bandoleers per standard ammunition can. This yields 1120 rounds of 5.56×30 mm MARS rather than 840 rounds of M855. MARS provides an increase in rounds for weight and volume being moved through the logistic system. A pound of 9 mm ammunition is 36 rounds while a pound of 5.56×30 mm MARS is 45 rounds, a 25% increase in the number of rounds with each round being 30%–50% more effective.

With continued attention to FIGS. 3–8, the modified receiver assembly 22A as, noted, has a reduced length as compared with the receiver assembly 22 of its predecessor firearm. A modified hammer 44A, viewing especially FIGS. 3, 4, and 5 includes a hammer face 92 having a first recess 94 with a base surface 96 intended to squarely impact a firing base 98 (see FIG. 7) of a modified firing pin 50A. In this regard, it is noted that a butt end 100 of the firing pin 50 of the known design (FIG. 2) has been eliminated in order to expose the firing base 98 of the modified firing pin. By reason of these modifications, the hammer 44A continues to be pivotably mounted on the axis of its predecessor hammer 44 and still be able to squarely address the firing pin 50A.

The modified hammer 44A is also formed with a second transversely extending recess 102. In the known bolt assembly 26 (FIG. 2), a retaining pin 104 mounted on the bolt carrier 48 extends across the path of the firing pin 50 and is engageable with the annular flange 64 to thereby define the range of movement of the firing pin. In the modified construction of the invention, the retaining pin 104 continues to be engageable with the flange 64 of the modified firing pin 50A to define the limit of rearward motion of the firing pin 50A relative to the bolt carrier 48. Because of the shortened construction of receiver assembly 22A, the second transversely extending recess 102 is provided to clearingly receive (FIG. 4) the retaining pin 104 when the hammer 44A is at the limit of its travel in the clockwise direction (FIGS. 3 and 4) with firing base surface 96 engaged with the firing base 98 of the firing pin 50A. The recess 102 thus prevents an interference between retaining pin 104 that would otherwise be a consequence of the shortening of receiver 22.

It was previously explained that the known firearm has a gas passage tube 54 extending between the gas port 52 in the barrel 32 in a passage 54 on the bolt carrier 48 to actuate the automatic recoil of the bolt 56 and bolt carrier 48. Connecting the gas port 52 to the gas passage 54 is a gas tube 106. The expanding powder gases are then directed against a pressure surface 108 for driving the bolt carrier 48A toward the recoil position.

Figure 8:
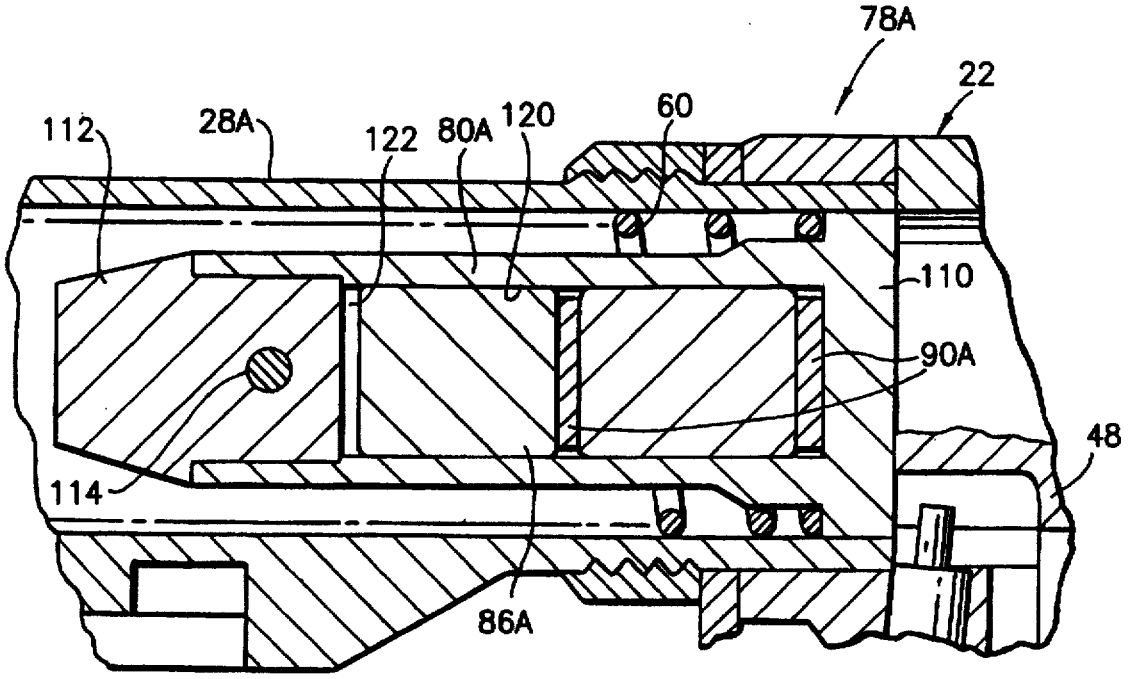
FIG. 8 is a detail side elevation view, in section, illustrating a buffer assembly modified according to the invention.

A modified recoil assembly 78A for the firearm of the invention is illustrated in FIG. 8 and includes a modified receiver extension 28A within which reciprocates a modified buffer body 80A which extends between a buffer end 110 and an opposed bumper 112 molded from polyurethane or other suitable material and fixed to the buffer body 80A by a cross pin 114. Because of the shortened length of the receiver extension 28A and of the buffer body 80A, modified coaxial weights 86A are fewer in number. The weights 86A are preferably of tungsten because of the high density of that material and its non corrosive characteristics, although other dense materials may be used to good effect. As with the weights 86, the weight 86A are preferably separated from one another and from the buffer end 110 by means of washers 90A similar to those used in the predecessor firearm. Also, by reason of the fact that the combined length of the weights 86A and of the washers 90A are shorter than the length of a base 120 within the buffer body 80A, as indicated by a space 122. The weights and washers are free to move longitudinally between the limits imposed by the bumper 112 and the buffer end 110. The weights 86A are of a magnitude which must be coordinated with the velocity of the recoiling components.

It was earlier noted that the present invention represents a completely new class of weapon system. While originally based on the M16 rifle, it is not merely an improved version of that venerable weapon. Even more noteworthy is the fact that the dramatically improved performance of the MARS system has been achieved at a time when development funds are scarce. Thus, it is significant that the MARS system has resulted with remarkably few changes to the known weapon system. As a result, few parts require certification for compliance with Military Standards, a costly and time consuming practice. Further, the cost of new tooling for production has been minimized. Finally, but by no means of less significance, is the result that the vast bulk of current inventory available for the M16-type firearm will continue to be of use and available to the soldier in battle, being common to both the M16 firearm and to the new MARS system firearm.

In short, while the changes made to the conventional M16 rifle resulting in the MARS system of the present invention may, at first glance, appear to be minor, upon reflection they will be seen as indeed being significant, resulting in a quantum advance in the field of personal weaponry.

While preferred embodiments of the invention have been disclosed in detail, it should be understood by those skilled in the art that various other modifications may be made to the illustrated embodiments without departing from the scope of the invention as described in the specification and defined in the appended claims.

What is claimed is:

1. A gas operated firearm comprising:

a receiver assembly having a longitudinal cavity therein;

a bolt assembly extending between forward and aft ends mounted in the longitudinal cavity for reciprocal movement between recoil and battery positions and having a forwardly facing pressure surface, said bolt assembly having first and second longitudinally extending coaxial bores therein and including an elongated firing pin having a main shaft slidable in the first bore extending between a head and a firing base and an annular flange intermediate said head and said firing base, said annular flange being slidable in the second bore, said bolt assembly including a transversely extending retaining pin engageable by said annular flange to define an aftward terminal position of said firing pin on said bolt assembly;

a recoil assembly mounted in the longitudinal cavity for rectilinear movement with said bolt assembly between the recoil and battery positions, said recoil assembly including means to bias said bolt assembly toward the battery position;

a trigger mechanism including:

a hammer mounted for movement between a cocked position distant from said firing base of said firing pin and a firing position engaged therewith;

means biasing said hammer toward said firing position;

a trigger having a trigger sear thereon engaged with said hammer to hold said hammer in the cocked position, said trigger being selectively movable to disengage said trigger sear from said hammer allowing movement of said hammer toward the firing position under the bias of said biasing means;

a barrel mounted on said receiver assembly at a receiving end defining a firing chamber and extending to a distal end and having a longitudinally extending barrel bore coaxial with the first and second bores in said bolt assembly and having a gas port intermediate said receiving end and a discharge end of the barrel;

a gas passage tube extending between the gas port and said pressure surface for directing expanding powder gases, from a cartridge after a bullet thereof has traveled outwardly through the barrel bore, through the gas port, then through said gas passage tube, then against said pressure surface for driving said bolt assembly toward the recoil position;

characterized in that said hammer including a hammer face having a first recess with a base surafce for squarely impacting said firing base of said firing pin and a second transversely extending recess for reception of said retaining pin when said hammer reaches the firing position.

2. A gas operated firearm as set forth in claim 1 including:

means operable for feeding a fresh cartridge into the firing chamber after a spent cartridge has been ejected therefrom when said bolt assembly is in the battery position.

3. A gas operated firearm as set forth in claim 1:

wherein said recoil assembly includes a buffer mounting an elongated mass segmented into a plurality of coaxial weights, said weights having a lost motion connection with said buffer and with each other for transmitting to said bolt assembly the force resulting from their inertia.

4. A gas operated firearm as set forth in claim 3 including:

wherein said weights are of a magnitude coordinated with the velocity of said recoil assembly so as to reduce rebound in the battery position of said assembly during automatic fire.

5. A gas operated firearm as set forth in claim 3 wherein said buffer includes a bumper having a low coefficient of restitution engageable with the end of the longitudinal cavity in recoil position to minimize the shock of recoil movement.

6. A gas operated firearm as set forth in claim 3 wherein a plurality of washers having a low coefficient of restitution are disposed between each adjacent pair of said weights.

7. A gas operated firearm as set forth in claim 3 wherein said plurality of weights are disposed within a longitudinal cavity provided by said buffer.

8. A gas operated firearm as set forth in claim 7 wherein the longitudinal cavity provided by said buffer is sealed against the entry of contaminants.

9. A gas operated firearm as set forth in claim 3 wherein said buffer includes two weights composed of tungsten.

10. In a firearm having a frame, a barrel connected to the frame, and a firing mechanism connected to the frame, the firing mechanism having a firing pin and a hammer pivotably connected to the frame for striking the firing pin, wherein the improvement comprises:

the hammer having a hammer face with a first recess having a recessed base surface for directly contacting the firing pin when the hammer strikes the firing pin.

11. A firearm as in claim 10 wherein the hammer face has a second recess therein.

12. A firearm as in claim 11 wherein the second recess extends transversely across the hammer face, the second recess receiving a retaining pin on a bolt carrier of the firing mechanism when the hammer strikes the firing pin.

* * * * *